US010279238B1

(12) United States Patent
Yu

(10) Patent No.: US 10,279,238 B1
(45) Date of Patent: May 7, 2019

(54) WIDTH-ADJUSTABLE SKATE WITH INTERCHANGEABLE FUNCTION

(71) Applicant: Juei-Chieh Yu, Dongguan (CN)

(72) Inventor: Juei-Chieh Yu, Dongguan (CN)

( * ) Notice: Subject to any disclaimer, the term of this patent is extended or adjusted under 35 U.S.C. 154(b) by 0 days.

(21) Appl. No.: 15/989,866

(22) Filed: May 25, 2018

(51) Int. Cl.
*A63C 1/26* (2006.01)
*A63C 17/00* (2006.01)

(52) U.S. Cl.
CPC ..... *A63C 1/26* (2013.01); *A63C 17/0086* (2013.01)

(58) Field of Classification Search
CPC ..... A43B 3/26; A43B 5/1608; A43B 5/1633; A63C 2203/48; A63C 2203/06; A63C 17/18
See application file for complete search history.

(56) References Cited

U.S. PATENT DOCUMENTS 2,868,553 A * 1/1959 Rieckman ..... A63C 17/18 280/11.27
4,008,901 A * 2/1977 Conn ..... A63C 17/18 280/11.3
7,137,635 B2 * 11/2006 Haugen ..... A43B 3/26 280/11.26

* cited by examiner

*Primary Examiner* — Bryan A Evans
(74) *Attorney, Agent, or Firm* — Muncy, Geissler, Olds & Lowe, P.C.

(57) ABSTRACT

The utility model discloses a width-adjustable skate with an interchangeable function, including a shell, a toe cap, a width adjustment screw, and a width adjustment moving part. The bottom of the shell is provided with a replaceable sliding assembly. By means of the replaceable sliding assembly, a user can mount a blade-type sliding assembly or a roller-type sliding assembly as required, thus implementing interchange. Moreover, the width of the skate is adjustable, such that the user feels more comfortable when wearing it.

7 Claims, 4 Drawing Sheets

WIDTH-ADJUSTABLE SKATE WITH INTERCHANGEABLE FUNCTION

TECHNICAL FIELD

The utility model relates to the field of roller blades or ice skates, and in particular, to a width-adjustable skate with an interchangeable function.

BACKGROUND ART

Skates are a kind of entertainment sports goods, and are divided into ice skates, roller blades, and roller skates. The ice skate is provided with a sharp blade at the shoe sole, the roller blade is provided with four wheels in two rows at the shoe sole, and the roller skate is provided with four wheels in one row at the shoe sole. By use of rolling and sliding principles, these skates enable a person to slide at a high speed and make various marvelous actions.

At present, the three kinds of skates are not interchangeable, bringing inconvenience to users. Therefore, the current skates need to be improved.

SUMMARY OF THE UTILITY MODEL

In view of the above, to overcome the defect in the prior art, a major objective of the utility model is to provide a width-adjustable skate with an interchangeable function, which can effectively solve the problem that the existing skates are not interchangeable.

To implement the above objective, the utility model adopts the following technical solution:

A width-adjustable skate with an interchangeable function, including a shell, a toe cap, a width adjustment screw, and a width adjustment moving part; the toe cap being disposed on the shell; the width adjustment screw and the width adjustment moving part being both sandwiched between the shell and the toe cap, the width adjustment screw being disposed movably and extending horizontally, the head of the width adjustment screw being exposed to the shell, the width adjustment moving part being connected to the width adjustment screw by screw, and the shell and the toe cap being both fixedly connected to the width adjustment moving part; wherein the bottom of the shell is provided with a replaceable sliding assembly, the sliding assembly comprises a base and a blade or roller that is disposed on the base, and the base is replaceably mounted at the bottom of the shell.

Preferably, the base is replaceably mounted at the bottom of the shell by using screws.

Preferably, front and rear ends of the base are each provided with a first fixing hole, bottoms of the front and rear ends of the shell are each provided with a second fixing hole, and two screws pass through the corresponding second fixing holes and the corresponding first fixing holes for fixed connection.

Preferably, the top of the base is provided with a positioning portion, the bottom of the shell is provided with a positioning slot, and the positioning portion is embedded into the positioning slot.

Preferably, a through-groove, a clamping slot, and an embedding slot that are sequentially in communication with one another are recessed in the middle of the surface of the shell, the width adjustment screw is embedded into the clamping slot, the head of the width adjustment screw is embedded into the through-groove and passes through the through-groove to be exposed to the bottom surface of the shell, and the width adjustment moving part is embedded into the embedding slot.

Preferably, an upper through-hole is formed by penetrating through upper and lower surfaces at one side of the toe cap, the width adjustment moving part is provided with an upper fixing hole, and an upper fixing screw passes through the upper through-hole to be fixedly connected to the upper fixing hole by screw.

Preferably, a lower through-hole is formed by penetrating through upper and lower surfaces at one side of the shell, the width adjustment moving part is provided with a lower fixing hole, and a lower fixing screw passes through the lower through-hole to be fixedly connected to the lower fixing hole by screw.

Compared with the prior art, the utility model has obvious advantages and beneficial effects. Specifically, it can be known from the foregoing technical solution that:

By disposing a replaceable sliding assembly at the bottom of a shell, a user can mount a blade-type sliding assembly or a roller-type sliding assembly as required, thus implementing interchange and bringing convenience to the user. Moreover, the width of the skate is adjustable, such that the user feels more comfortable when wearing it.

The utility model is described in detail with reference to accompanying drawings and specific embodiments, to further clearly describe the structural features and effects of the utility model.

LIST OF REFERENCE NUMERALS

Figure 1:
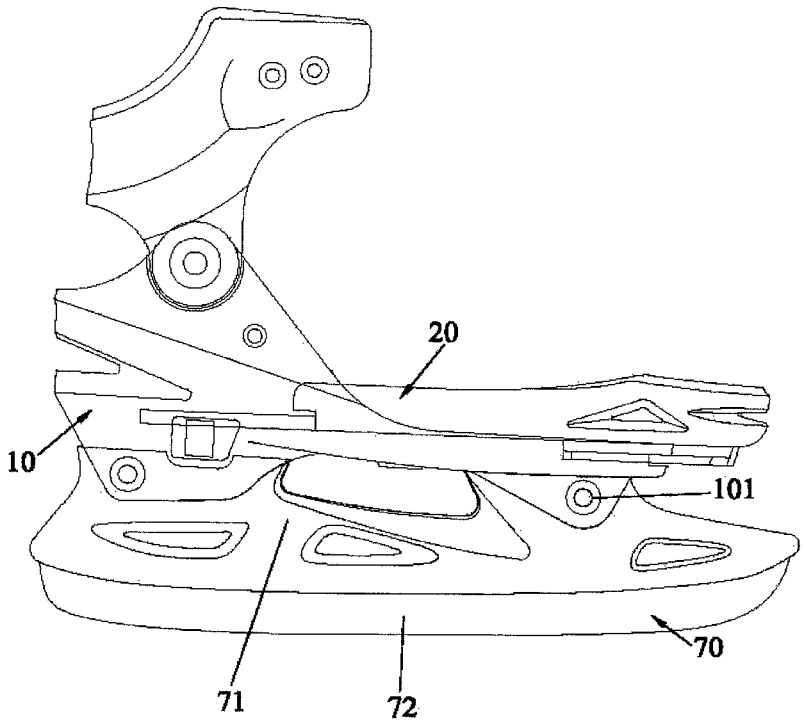
FIG. 1 is a front view of a preferred embodiment according to the utility model.

10. Shell
11. Through-groove
12. Clamping slot
13. Embedding slot
101. Second fixing hole
102. Positioning slot
14. Lower through-hole
20. Toe cap
21. Upper through-hole
30. Width adjustment screw
31. Head
40. Width adjustment moving part
41. Upper fixing hole
42. Lower fixing hole
50. Upper fixing screw
60. Lower fixing screw
72. Blade or roller
73. Screw
701. First fixing hole
702. Positioning portion

DETAILED DESCRIPTION

Figure 2:
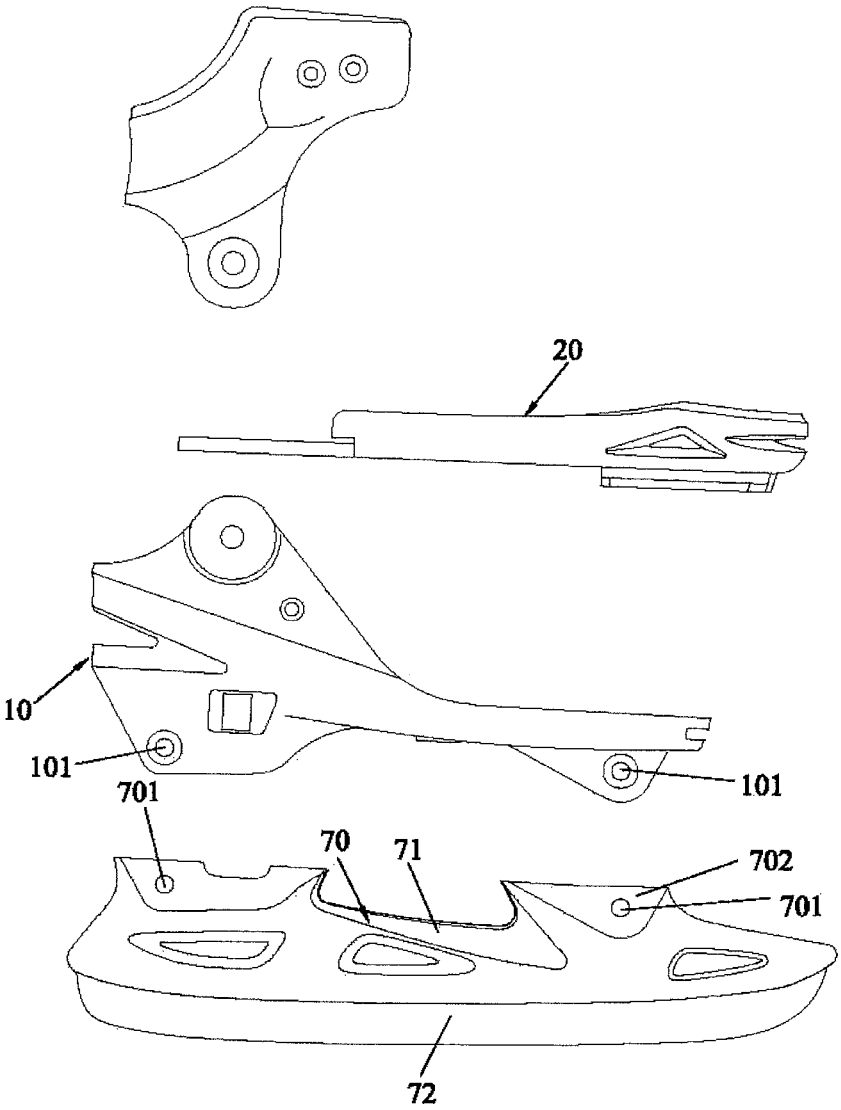
FIG. 2 is an exploded front view of a preferred embodiment according to the utility model.
Figure 3:
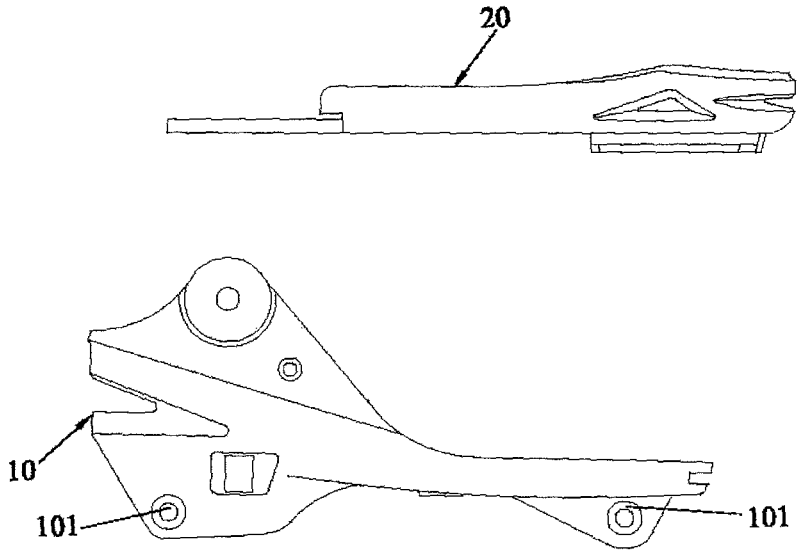
FIG. 3 is a partially exploded front view of a preferred embodiment according to the utility model.
Figure 4:
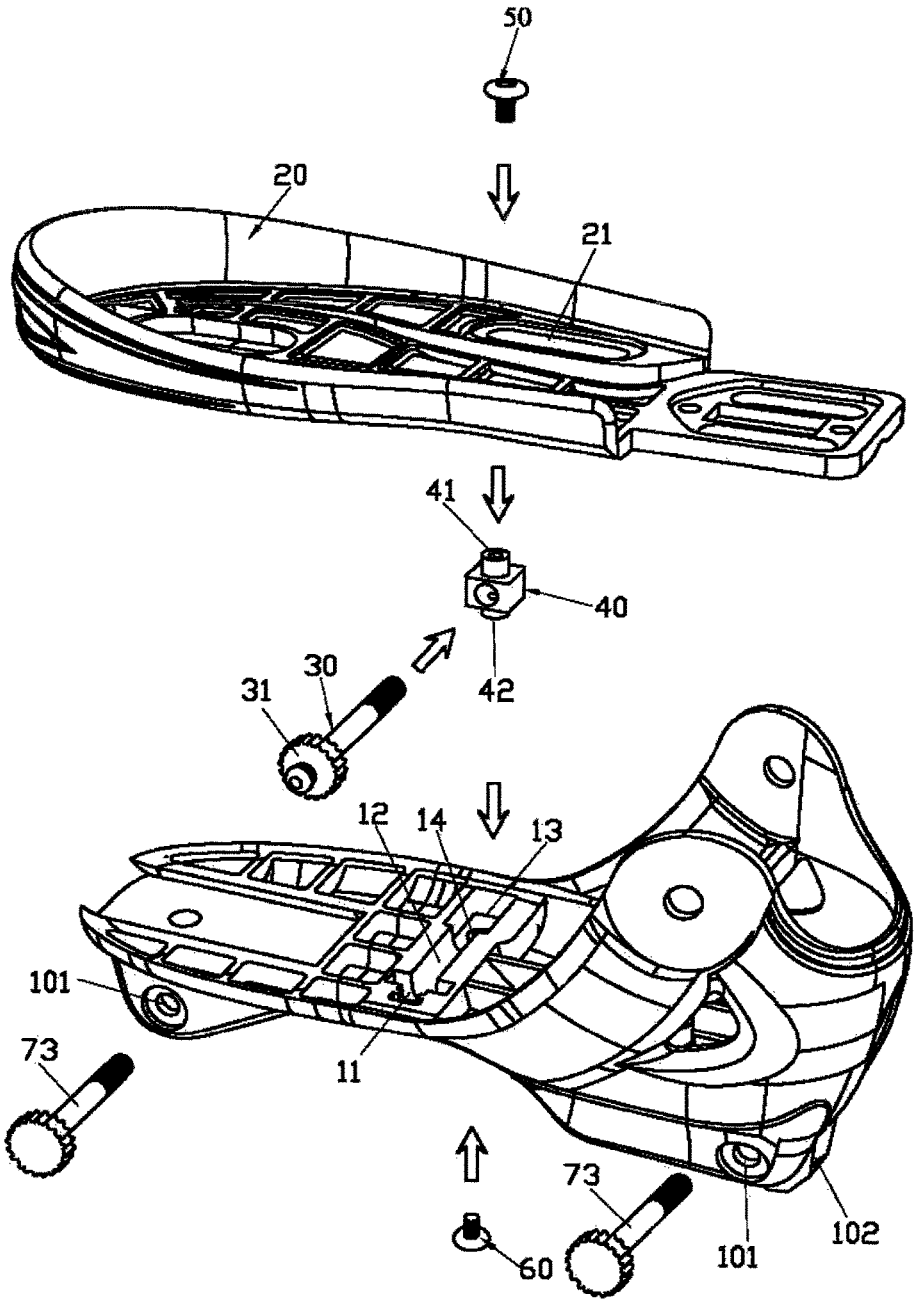
FIG. 4 is a partially exploded three-dimensional view of a preferred embodiment according to the utility model.

Referring to FIG. 1 to FIG. 4, a specific structure of a preferred embodiment in the utility model is shown, which includes a shell 10, a toe cap 20, a width adjustment screw 30, and a width adjustment moving part 40.

The toe cap 20 is disposed on the shell 10. The width adjustment screw 30 and the width adjustment moving part 40 are both sandwiched between the shell 10 and the toe cap 20. The width adjustment screw 30 is disposed movably and extends horizontally. The head 31 of the width adjustment screw 30 is exposed to the shell 10. The width adjustment moving part 40 is connected to the width adjustment screw 30 by screw. The shell 10 and the toe cap 20 are both fixedly connected to the width adjustment moving part 40.

In this embodiment, a through-groove 11, a clamping slot 12, and an embedding slot 13 sequentially in communication with one another are recessed in the middle of the surface of the shell 10. The width adjustment screw 30 is embedded into the clamping slot 12. The head of the width adjustment screw 30 is embedded into the through-groove 11 and passes through the through-groove 11 to be exposed to the bottom surface of the shell 10. The width adjustment moving part 40 is embedded into the embedding slot 13.

Also, an upper through-hole 21 is formed by penetrating through upper and lower surfaces at one side of the toe cap 20, the width adjustment moving part 40 is provided with an upper fixing hole 41, and an upper fixing screw 50 passes through the upper through-hole 21 to be fixedly connected to the upper fixing hole 41 by screw. Moreover, a lower through-hole 14 is formed by penetrating through upper and lower surfaces at one side of the shell 10, the width adjustment moving part 40 is provided with a lower fixing hole 42, and a lower fixing screw 60 passes through the lower through-hole 14 to be fixedly connected to the lower fixing hole 42 by screw.

In addition, the bottom of the shell 10 is provided with a replaceable sliding assembly 70. The sliding assembly 70 includes a base 71 and a blade or roller 72 that is disposed on the base 71. The base 71 is replaceably mounted at the bottom of the shell 10. In this embodiment, the base 71 is replaceably mounted at the bottom of the shell 10 by using screws. Moreover, front and rear ends of the base 71 are each provided with a first fixing hole 701, bottoms of the front and rear ends of the shell 10 are each provided with a second fixing hole 101, and two screws 73 pass through the corresponding second fixing holes 101 and the corresponding first fixing holes 701 for fixed connection. Also, the top of the base 71 is provided with a positioning portion 702, the bottom of the shell 10 is provided with a positioning slot 102, and the positioning portion 702 is embedded into the positioning slot 102, to facilitate positioning. The roller 72 includes, but is not limited to, four wheels in one row or four wheels in two rows.

In use, the width adjustment screw 30 is rotated back and forth, such that the width adjustment moving part 40 moves back and forth horizontally along an axial direction of the width adjustment screw 30. The horizontal back-and-forth movement of the width adjustment moving part 40 expands or tightens the middle portion of the shell 10 and the middle portion of the toe cap 20, thus adjusting the horizontal width. When the blade or roller needs to be replaced, the screws 73 are loosened, the sliding assembly 70 is taken off, and another sliding assembly 70 is mounted thereto.

A design focus of the utility model lies in that: by disposing a replaceable sliding assembly at the bottom of a shell, a user can mount a blade-type sliding assembly or a roller-type sliding assembly as required, thus implementing interchange and bringing convenience to the user. Moreover, the width of the skate is adjustable, such that the user feels more comfortable when wearing it.

The technical principles of the utility model are described above with reference to the specific embodiments. These descriptions are merely used for explain the principles of the utility model, and should not be construed as limitations to the protection scope of the utility model in any manner. Based on the explanation here, those skilled in the art can think of other specific implementation manners of the utility model without creative efforts, and all these manners will fall within the protection scope of the utility model.

The invention claimed is:

1. A width-adjustable skate with an interchangeable function, comprising a shell, a toe cap, a width adjustment screw, and a width adjustment moving part; the toe cap being disposed on the shell; the width adjustment screw and the width adjustment moving part being both sandwiched between the shell and the toe cap, the width adjustment screw being disposed movably and extending horizontally, a head of the width adjustment screw being exposed to the shell, the width adjustment moving part being connected to the width adjustment screw by screwing, and the shell and the toe cap being both fixedly connected to the width adjustment moving part; wherein a bottom of the shell is provided with a replaceable sliding assembly, the sliding assembly comprises a base and a blade or roller that is disposed on the base, and the base is replaceably mounted at the bottom of the shell.

2. The width-adjustable skate with an interchangeable function according to claim 1, wherein the base is replaceably mounted at the bottom of the shell by using screws.

3. The width-adjustable skate with an interchangeable function according to claim 2, wherein front and rear ends of the base are each provided with a first fixing hole, bottoms of the front and rear ends of the shell are each provided with a second fixing hole, and two screws pass through the corresponding second fixing holes and the corresponding first fixing holes for fixed connection.

4. The width-adjustable skate with an interchangeable function according to claim 1, wherein a top of the base is provided with a positioning portion, the bottom of the shell is provided with a positioning slot, and the positioning portion is embedded into the positioning slot.

5. The width-adjustable skate with an interchangeable function according to claim 1, wherein a through-groove, a clamping slot, and an embedding slot sequentially in communication with one another are recessed in a middle of a surface of the shell, the width adjustment screw is embedded into the clamping slot, the head of the width adjustment screw is embedded into the through-groove and passes through the through-groove to be exposed to a bottom surface of the shell, and the width adjustment moving part is embedded into the embedding slot.

6. The width-adjustable skate with an interchangeable function according to claim 1, wherein an upper through-hole is formed by penetrating through upper and lower surfaces at one side of the toe cap, the width adjustment moving part is provided with an upper fixing hole, and an upper fixing screw passes through the upper through-hole to be fixedly connected to the upper fixing hole by screwing.

7. The width-adjustable skate with an interchangeable function according to claim 1, wherein a lower through-hole is formed by penetrating through upper and lower surfaces at one side of the shell, the width adjustment moving part is provided with a lower fixing hole, and a lower fixing screw passes through the lower through-hole to be fixedly connected to the lower fixing hole by screwing.

* * * * *